US007078082B2

(12) United States Patent
Adams

(10) Patent No.: US 7,078,082 B2
(45) Date of Patent: Jul. 18, 2006

(54) DUAL-FUNCTIONING MECHANISM FOR STARTUP DURING WINDING OF WEB MATERIAL AND FOR SPLICING DURING UNWINDING

(75) Inventor: Angela Hurst Adams, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 80 days.

(21) Appl. No.: 10/757,798

(22) Filed: Jan. 15, 2004

(65) Prior Publication Data

US 2005/0155714 A1 Jul. 21, 2005

(51) Int. Cl.
*B31F 5/00* (2006.01)
*B32B 9/00* (2006.01)
*B65H 19/00* (2006.01)

(52) U.S. Cl. ..... 428/40.1; 156/157; 156/184; 156/185; 156/188; 156/443; 156/502; 156/504; 242/556.1; 428/41.8; 428/42.2; 428/192; 428/194; 428/906

(58) Field of Classification Search ..... 428/40.1, 428/41.8, 42.2, 192, 194, 906; 242/556.1; 156/502, 504, 157, 184, 185, 188, 443
See application file for complete search history.

(56) References Cited

U.S. PATENT DOCUMENTS

| | | | | |
|---|---|---|---|---|
| 2,320,656 A | | 6/1943 | Roesen | |
| 3,765,615 A | | 10/1973 | Brink et al. | |
| 4,172,755 A | | 10/1979 | Gustafson et al. | |
| 5,212,002 A | | 5/1993 | Madrzak et al. | |
| 5,397,076 A | | 3/1995 | Padilla | |
| 5,692,699 A | * | 12/1997 | Weirauch et al. | 242/556.1 |
| 5,855,714 A | | 1/1999 | Bockh | |
| 5,996,927 A | * | 12/1999 | Weirauch et al. | 242/556.1 |
| 6,387,204 B1 | | 5/2002 | Deprez et al. | |
| 6,432,241 B1 | | 8/2002 | Congard et al. | |
| 6,478,247 B1 | | 11/2002 | Fujiwara et al. | |
| 2002/0056784 A1 | | 5/2002 | Davies et al. | |
| 2003/0106629 A1 | | 6/2003 | Manteufel et al. | |
| 2003/0211272 A1 | | 11/2003 | Cry et al. | |

FOREIGN PATENT DOCUMENTS

| | | |
|---|---|---|
| DE | 102 06 575 | 8/2003 |
| EP | 0 941 954 A1 | 9/1999 |
| GB | 1 211 359 | 11/1970 |
| JP | 63235242 | 9/1988 |

* cited by examiner

OTHER PUBLICATIONS

Copy of European Search Report for European Application No. 04257601.7; Filed Dec. 7, 2004; Date of Completion Apr. 25, 2005.

*Primary Examiner*—Nasser Ahmad
(74) *Attorney, Agent, or Firm*—Alston & Bird LLP

(57) ABSTRACT

A tail end of a web is attached to a winding core via a two-component mechanism having a core component attached to the core and a web component attached to the web, the two components being attached to each other in releasable fashion. The mechanism assists startup of winding. Upon completion of unwinding, the web component detaches from the core component to expose a region of adhesive on a part of the web component that extends from the tail end of the web. The tail end thus can be spliced to a leading end of another web by attaching the leading end to the exposed adhesive on the web component.

14 Claims, 3 Drawing Sheets

DUAL-FUNCTIONING MECHANISM FOR STARTUP DURING WINDING OF WEB MATERIAL AND FOR SPLICING DURING UNWINDING

BACKGROUND OF THE INVENTION

The invention relates to the winding of web materials about winding cores to form rolls of the materials, and the subsequent unwinding of the web materials from the rolls and splicing of a web tail end of a depleted roll to the web leading end of a new roll.

Web materials such as polymer film, paper, nonwoven or woven textile, metal foil, sheet metal, and others, are used in the manufacture of a variety of products. The web materials generally are provided in the form of large rolls formed by winding the web material about a winding core. To begin the winding process, a tail end of a web is attached to the winding core and the core is rotated about its axis to wind the web into a roll.

To manufacture products, the web material is unwound from the roll and subjected to converting operations, the particulars of which vary depending on the products being made. When the web from one roll is fully unwound, a splicing operation is performed wherein the leading end of the web from a new, full roll is attached to the tail end of the just-depleted roll, so that web material may be continuously supplied to the converting machinery.

Various approaches to the splicing of web material have been used, but the operation generally entails the use of some type of adhesive tape or substance for attaching the tail and leading ends of the webs together. If the adhesive were present on the tail end of a web prior to winding, the adhesive generally would have to face away from the core because that is the side of the web that will be brought into contact with the leading end of the new web to form the splice. Accordingly, the adhesive would stick to the subsequent turn of the web when the web is wound into a roll, which is clearly undesirable. Thus, some provision for preventing such sticking is necessary. U.S. Pat. No. 5,855,714 to Bockh proposes to overcome this difficulty by providing a non-adherable region on the tail end of the web adjacent the adhesive. The non-adherable region is long enough to extend at least one full turn about the core so that the adhesive is contacted by the non-adherable region and thereby is prevented from sticking. It may not be convenient or practical to form a non-adherable region on some types of web material, and in any event it would require a separate operation on the web prior to winding.

Additionally, mechanisms for splicing web materials generally have not aided or performed any function associated with the winding of the web into a roll.

BRIEF SUMMARY OF THE INVENTION

The present invention addresses the above needs and achieves other advantages, by providing a dual-functioning mechanism that aids in splicing of webs and that can also aid in the startup of the winding process. The mechanism in certain embodiments of the invention generally comprises two components that initially are attached to each other at the startup of winding, but that detach from each other at completion of unwinding so as to expose a previously unexposed adhesive region that can attach to the leading end of another web to accomplish a splice. The mechanism is connected between the tail end of a web and a winding core so as to affix the web to the core prior to winding the web into a roll about the core. The attachment of the web to the core provided by the mechanism is sufficiently strong to withstand the tension exerted on the web at the start of winding without the two components of the mechanism detaching from each other. At completion of unwinding, however, the tension exerted on the web tending to pull the two components apart serves to separate the components and thereby expose an adhesive region on the component that remains attached to the tail end of the web.

The mechanism generally comprises a core component for attachment to the core and a web component for attachment to the web. In some embodiments of the invention, the core component has a core-attaching portion structured and arranged to attach to the core and a free end portion joined to the core-attaching portion, the free end portion extending out from the core when the core-attaching portion is attached to the core. The web component has a tail portion structured and arranged to attach to a tail end of a web and a leading portion joined to the tail portion, the leading portion extending out from the tail end of the web when the tail portion is attached to the tail end. The leading portion has adhesive disposed thereon and is adhered to the core component with sufficient adhesive bonding strength to remain attached when winding tension is exerted between the core and the tail end of the web during startup of winding of the web onto the core to form a roll. However, the adhesive bonding strength is low enough to allow the leading portion of the web component to detach from the core component at completion of unwinding of the roll such that the adhesive on the leading portion extending from the tail end of the web is exposed for attachment to a leading end of another web being unwound from a new roll to splice the webs together.

The adhesive on the leading portion of the web component in one embodiment is substantially completely covered by the free end portion of the core component when the two components are joined together at startup of winding of the web. In this manner, the adhesive on the leading portion is prevented from sticking to a subsequent turn of the web during winding.

The web component conveniently can comprise a splicing tape. A portion of the length of the tape is affixed to the tail end of the web, and the remaining portion of the length extends beyond the tail end for attachment to the core component.

The core component can have various configurations and constructions. In one embodiment of the invention, the core component comprises a substrate (e.g., paper, plastic film, cloth, etc.) that includes a release material disposed on one side of the substrate over a portion of the substrate length. The remainder of the substrate length (or at least a part thereof) is attached to the core prior to winding of a web about the core. An adhesive can be applied to the core for the attachment of the substrate, or adhesive can be disposed on the substrate, or adhesive can be disposed on both the core and the substrate.

In accordance with another embodiment of the invention, the core component comprises a substrate having an upper surface and a lower surface, with a release material covering the upper surface. A portion of the length of the substrate is folded over such that part of the substrate comprises two layers and the rest comprises a single layer. The part having two layers forms the free end portion for attachment to the web component, and has the release material disposed on both of its opposite surfaces by virtue of the folded-over portion. The part having one layer forms the core-attaching portion that is attached to the core prior to winding. Advantageously, the folded-over portion of the substrate is free to unfold upon completion of unwinding when the tail end of the web is pulled away from the core. As the folded-over portion of the substrate is unfolded, it moves into a more-advantageous orientation relative to the web component attached to it for peeling the web component off the substrate.

The core-attaching portion of the core component can have a double-sided adhesive tape, or a layer of adhesive, disposed on its lower surface for attaching the core component to the core. The core-facing side of the adhesive tape, or the adhesive layer, can have a release liner attached to it to prevent sticking of the core component to various objects until it is desired to attach the core component to the core. The release liner can be peeled off to expose the adhesive tape or adhesive layer just prior to attaching the core component to the core.

Similarly, prior to attaching the web component to the tail end of the web, the portion of the web component that is not attached to the core component can have a release liner attached to the adhesive surface. The release liner can be peeled off to expose the adhesive surface just prior to attaching the web component to the web.

In another embodiment of the invention, the web component comprises a splicing tape having a tail portion attached to the tail end of the web and a leading portion that extends out from the tail end. The leading portion is folded beneath the tail portion so that the adhesive on the leading portion faces away from the tail portion. The leading portion is adhered to the release surface of the core component. The core component can comprise a substrate having one portion attached to the core and a free end portion that extends out from the core. Alternatively, the core component can comprise a layer of release material disposed on the core. Upon unwinding, the folded splicing tape unfolds and detaches from the core component, thereby exposing the adhesive on the leading portion of the splicing tape for splicing the tail end of the web to a leading end of another web.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 8A:
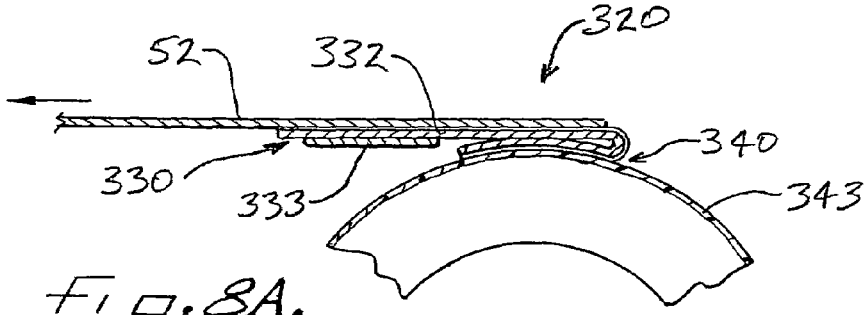
Figure 8B:
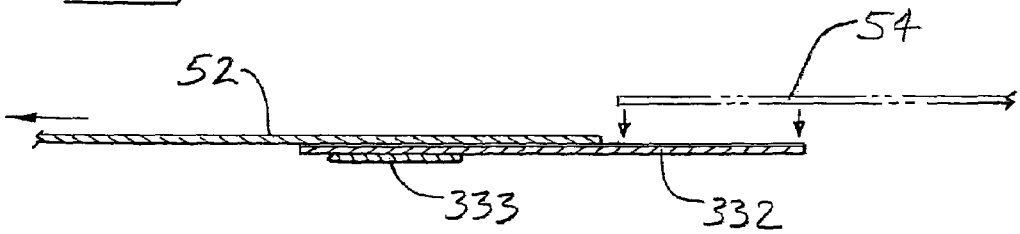

FIG. 8A illustrates a startup and splicing mechanism in accordance with a sixth embodiment of the invention, attaching a tail end of a web to a core, at a moment in time when the tail end of the web just begins to be advanced away from the core of the unwinding roll; and FIG. 8B is a view similar to FIG. 8A, at a later moment in time when the web component of the startup and splicing mechanism has completely detached from the core so as to expose the adhesive on the leading portion of the web component.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
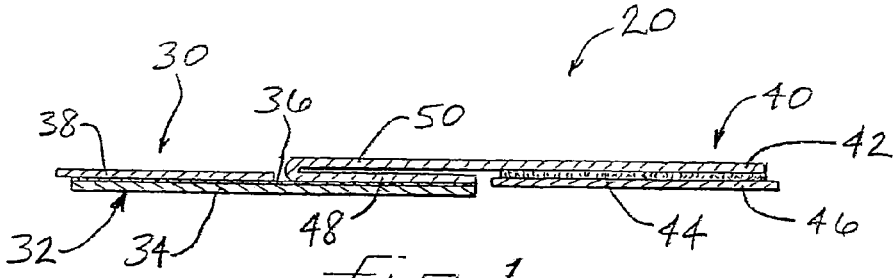
FIG. 1 depicts a cross-sectional view of a startup and slicing mechanism in accordance with a first embodiment of the invention.

A dual-functioning mechanism for startup and splicing of a webs in accordance with a first embodiment of the invention, is depicted in FIG. 1 and broadly designated by reference numeral 20. The mechanism 20 comprises a web component 30 for attachment to a tail end of a web and a core component 40 for attachment to a winding core. The web component comprises a splicing tape 32 formed by a backing 34 of suitable sheet material (e.g., paper, plastic film, cloth, etc.) and a layer of adhesive 36 covering one side of the backing. A release liner 38, which can comprise, for example, a silicone-coated paper or the like, covers the adhesive 36 on one lengthwise portion of the splicing tape and is adhered to the adhesive in releasable fashion. The remaining length of the splicing tape is adhered by the adhesive 36 to a portion of the core component 40. The adhesive 36 preferably comprises a pressure-sensitive adhesive (PSA), i.e., a material that adheres to a wide variety of materials upon application of pressure.

The core component 40 comprises a substrate 42 of suitable sheet material (e.g., paper, plastic film, cloth, etc.). A layer of adhesive 44 is disposed on one side of one lengthwise portion of the substrate. A release liner 46, which can comprise, for example, a silicone-coated paper or the like, covers the adhesive 44 and is adhered to the adhesive in releasable fashion. An end region 48 of the substrate, which is preferably free of adhesive, is folded beneath an adjoining region 50 of the substrate, which also is preferably free of adhesive. The folded end region 48 is adhered to the portion of the splicing tape 32 that is not covered by the release liner 38.

The surface of the folded end region 48 that is adhered to the splicing tape 32 preferably is such that it will readily peel off the splicing tape when the splicing tape is pulled away from the folded end region 48 in a direction out of the plane of the end region. To this end, the end region 48 can have a suitable release material (e.g., silicone, not shown) disposed thereon; alternatively, the material of the substrate 42 itself may be such that the splicing tape will readily peel off the end region. However, the adhesive bond between the splicing tape and the end region 48 preferably is sufficiently strong to resist detachment of the splicing tape when the splicing tape is pulled away from the end region in a direction lying in the plane of the end region, i.e., in a direction tending to place the adhesive interface in shear as opposed to peeling it apart.

Figure 2:
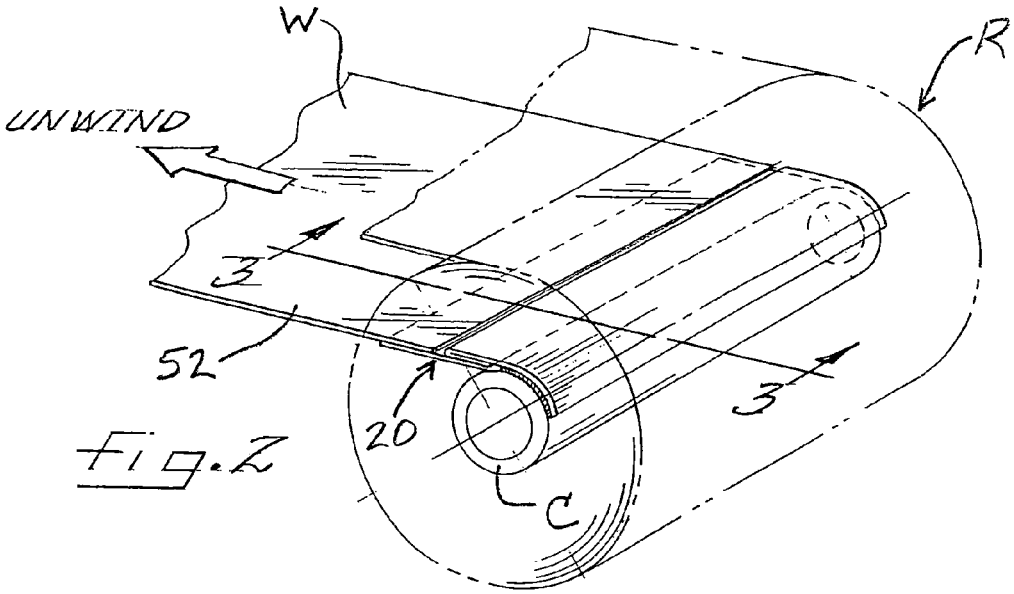
FIG. 2 is a perspective view of an unwinding roll of web material wherein the tail end of the web is attached to the core by the mechanism of FIG. 1.

As shown in FIG. 2, the mechanism 20 is used to attach a tail end 52 of a web W to the cylindrical outer surface of a winding core C to assist in startup of winding of the web about the core to form a roll R. The mechanism also facilitates splicing the tail end to a leading end of another web during unwinding of the roll, as explained below in connection with FIG. 3D. The mechanism 20 is shown as having a width, i.e., a dimension along the longitudinal direction of the winding core, that is substantially equal to the length of the core. However, the width of the mechanism could be less than the core length, or a plurality of separate mechanisms could be spaced apart along the length of the core.

More particularly, the mechanism 20 is prepared for use by first peeling off the release liner 46 from the adhesive 44 on the substrate 42 of the core component 40. The portion of the substrate 42 having the thus-exposed adhesive 44, which is referred to herein as the core-attaching portion, is affixed to the outer surface of the core C via the adhesive 44. The remaining portion of the substrate 42 remains unaffixed to the core and is referred to herein as the free end portion, and comprises the folded end region 48 and the adjoining overlying portion 50. The folded end region 48 thus lies between the outer surface of the core and the overlying portion 50 of the substrate. The free end portion of the substrate is affixed to the portion of the splicing tape 32 that is not covered by the release liner 38, which is referred to herein as the leading portion of the splicing tape.

Next, the release liner 38 is peeled off the splicing tape 32 to expose the adhesive 36 on the remaining portion of the splicing tape, which is referred to herein as the tail portion of the splicing tape. The tail portion of the splicing tape is then adhered to the tail end 52 of the web W via the thus-exposed adhesive 36. The web is now ready to begin winding about the core.

By virtue of the construction and arrangement of the mechanism 20, it will be recognized that as the core is rotated to begin winding the web about the core, the tension force between the core and the tail end tends to place the adhesive bond between the web component 30 and the core component 40 in shear rather than peeling it apart, and the web component remains attached to the core component. The core component 40 resists unfolding because the folded end region 48 is trapped between the core and the overlying portion 50. Thus, the mechanism 20 is sufficiently strong to remain intact under the levels of tension exerted during the startup of the winding process.

However, at the completion of unwinding of the roll during a converting operation or the like, the web component 30 readily detaches from the core component 40 such that the web component remains attached to the tail end of the web and provides an exposed adhesive surface for splicing the tail end to another web, as further explained below with reference to FIGS. 3A through 3D.

Figure 3A:
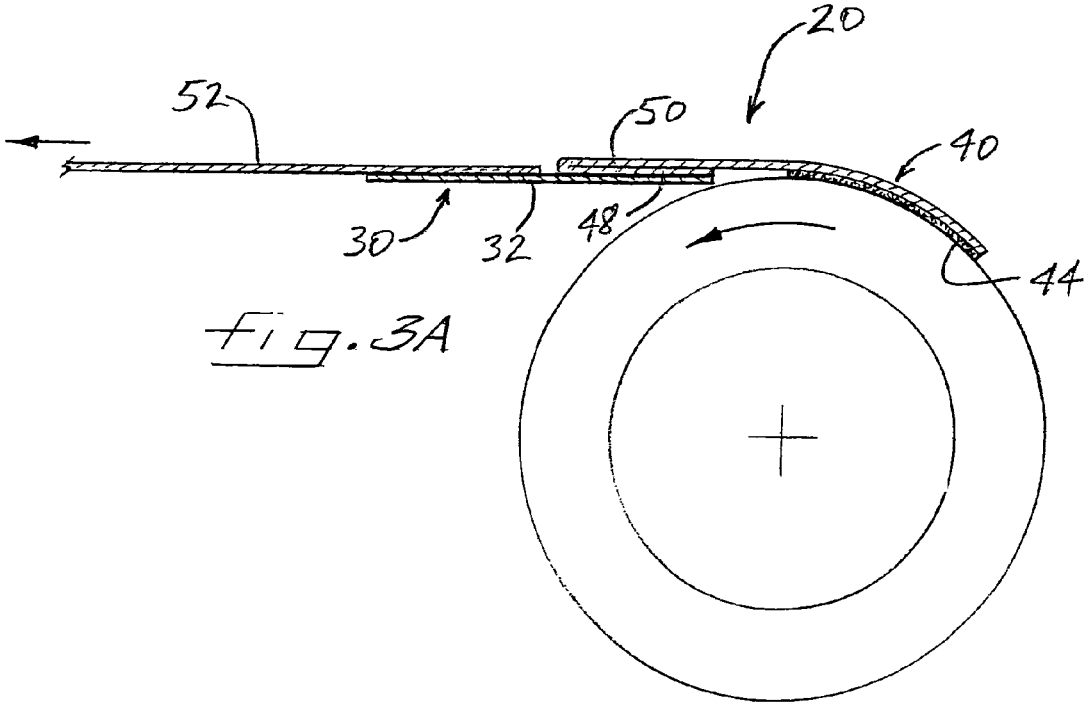
FIG. 3A is a cross-sectional view through the web and mechanism along line 3—3 in FIG. 2, at a moment in time when the tail end of the web just begins to be advanced away from the core of the unwinding roll.

FIG. 3A shows an unwinding roll at the completion of the unwinding operation, at the moment in time when the tail end 52 of the web just begins to be advanced away from the winding core and the free end portion of the substrate 42 of the core component begins to be pulled away from the outer surface of the core. At this point, the folded end region 48 is no longer prevented from unfolding by pressure exerted by the overlying portion 50.

Figure 3B:
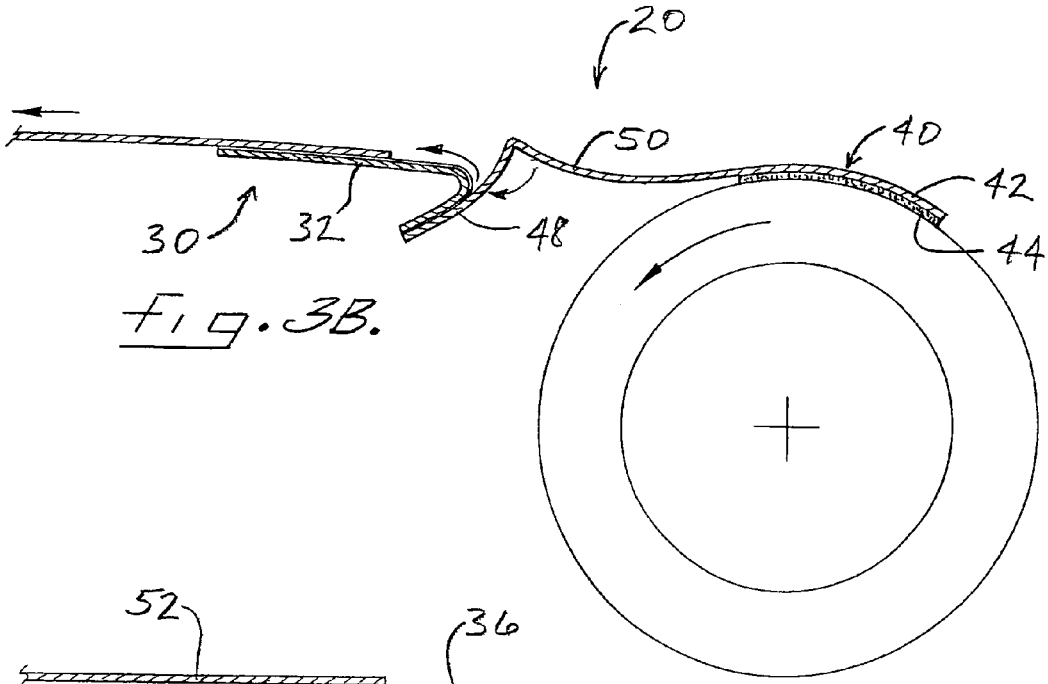
FIG. 3B is a view similar to FIG. 3A, at a later moment in time when the web component of the startup and splicing mechanism attached to the tail end of the web begins to separate from the core component of the mechanism attached to the core.

FIG. 3B shows a later instant in time as the tail end 52 continues to be advanced away from the core and the core continues to rotate. The substrate 42 of the core component begins to unfold as a result of the force exerted on the folded end region 48 by the splicing tape 32. Consequently, the end region 48 and splicing tape 32 are placed in relative orientations favoring peeling apart of the splicing tape and end region.

Figure 3C:
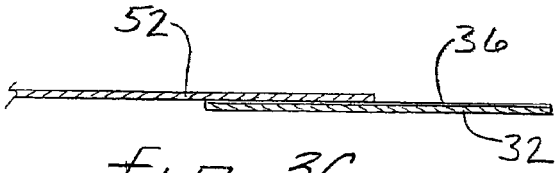
FIG. 3C shows the tail end of the web at a moment in time subsequent to that of FIG. 3B, after the web component has completely separated from the core component so as to expose the adhesive on the leading portion of the web component.

FIG. 3C shows a still later instant in time when the splicing tape 32 has completely detached from the substrate of the core component (which remains attached to the core, not shown). The splicing tape thus has a leading portion that extends away from the tail end 52 of the web and presents the adhesive 36 on the surface of the splicing tape facing away from the core.

Figure 3D:
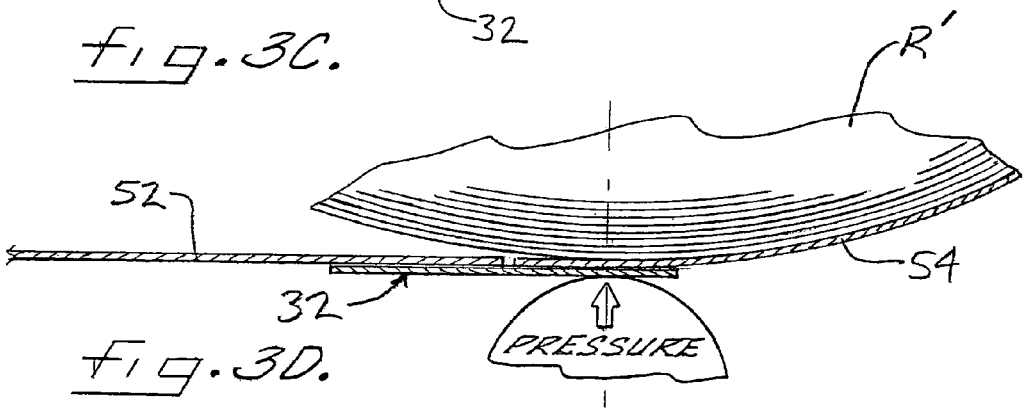
FIG. 3D depicts the tail end of the web being spliced to a leading end of a new roll of web material by adhering the leading end of the web to the exposed adhesive on the web component.

As depicted in FIG. 3D, the splicing tape 32 is used to splice the tail end 52 of the web to a leading end 54 of a new roll R' of web material. Various devices and processes can be used for accomplishing the splice, FIG. 3D merely showing in a highly schematic fashion that in general the leading end 54 and the splicing tape 32 are placed in overlying relation and pressure is exerted to press them together so that the leading end adheres to the splicing tape. The mechanism 20 is suitable for automated splicing operations performed while the webs are moving, often referred to as "flying" splices.

Figure 4:
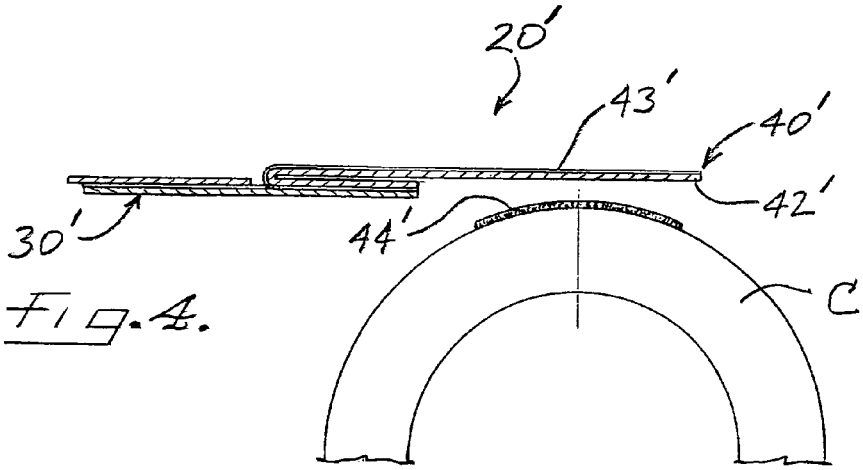
FIG. 4 illustrates a startup and splicing mechanism in accordance with a second embodiment of the invention.

FIG. 4 shows a second embodiment of a dual-functioning mechanism 20' in accordance with the invention. The mechanism 20' is generally similar to the mechanism described above, having a web component 30' as previously described and a core component 40' that differs somewhat from that of the first embodiment. In particular, the core component does not include adhesive on the substrate 42'; instead, an adhesive 44' is applied to the outer surface of the core just prior to affixing the core component to the core. Additionally, the substrate 42' has a coating of release material 43' (e.g., silicone or the like) on its upper surface. Thus, the release material is disposed on the core-facing side of the folded end region that is adhered to the splicing tape of the web component 30', and facilitates detachment of the splicing tape from the core component. The mechanism 20' functions in essentially the same way as the previously described mechanism.

Figure 5:
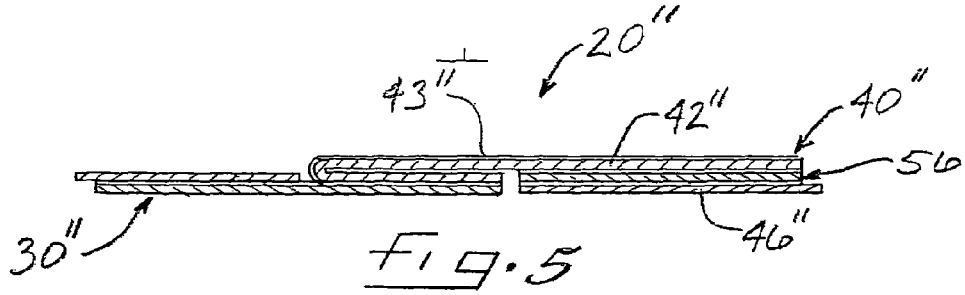
FIG. 5 shows a startup and splicing mechanism in accordance with a third embodiment of the invention.

FIG. 5 depicts a third embodiment of a mechanism 20" in accordance with the invention. The mechanism 20" is generally similar to the mechanism 20 of FIG. 1. The web component 30" is identical to the web component 30 of the first embodiment. The core component 40" is similar to the previously described core component 40, except that a double-sided adhesive tape 56 is attached to the substrate 42" for providing the adhesive surface by which the substrate is affixed to a winding core. One side of the double-sided tape 56 is affixed to the substrate. The opposite side of the tape has a release liner 46" releasably adhered thereto; the liner is removed just prior to affixing the core component to a core. The substrate 42" includes a coating of release material 43" as in the embodiment of FIG. 4. The mechanism 20" functions in essentially the same manner as described in connection with FIG. 1.

Figure 6:
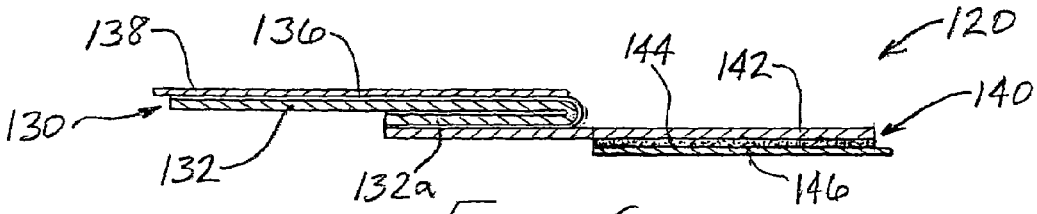
FIG. 6 depicts a startup and splicing mechanism in accordance with a fourth embodiment of the invention.

A fourth embodiment of a mechanism 120 in accordance with the invention is shown in FIG. 6. The mechanism includes a web component 130 releasably attached to a core component 140. The web component 130 comprises a splicing tape 132 having a backing 134 of suitable material (e.g., paper, plastic film, cloth, etc.) and a layer of adhesive 136 covering one side of the backing. Whereas in the first embodiment of FIG. 1 the core component is folded while the web component is flat, in the present embodiment the web component is folded while the core component is flat. Thus, the splicing tape 132 has a portion 132*a* that is folded beneath the rest of the tape; the portion 132*a* is referred to herein as the leading portion because it is the part of the tape that will extend out from the tail end of a web for splicing, as further explained below. The rest of the tape that overlies the folded or leading portion 132*a* is referred to herein as the tail portion because it is the part of the tape that is adhered to the tail end of the web. The adhesive 136 on the leading portion 132*a* faces away from the overlying tail portion, and is releasably adhered to a portion of the core component 140. A release liner 138 covers the adhesive 136 on the tail portion of the splicing tape, and is removed just prior to attaching the tail portion to the tail end of a web.

The core component 140 includes a substrate 142 of suitable material (e.g., paper, plastic film, cloth, etc.). One side of a first lengthwise portion of the substrate (referred to herein as the free end portion) is releasably adhered to the folded leading portion 132*a* of the splicing tape. On the opposite side of a second lengthwise portion of the substrate (referred to herein as the core-attaching portion) is a layer of adhesive 144; a release liner 146 covers the adhesive 144 and is removed just prior to affixing the core-attaching portion of the substrate 142 to a winding core. The free end portion of the substrate 142, to which the splicing tape 132 is adhered, remains unaffixed to the core. Before startup of winding of a web about the core, the release liner 136 is removed from the splicing tape and the tape is attached to the tail end of the web. The winding core is rotated to begin winding the web about the core.

During unwinding of the web from the roll, when the tail end of the web begins to be advanced away from the winding core, the splicing tape 132 peels off the substrate 142 and unfolds in the process. Once the splicing tape completely detaches from the substrate of the core component, the splicing tape assumes the configuration as shown in FIG. 3C and is positioned for splicing the tail end of the web to a leading end of another web as illustrated in FIG. 3D.

Figure 7:
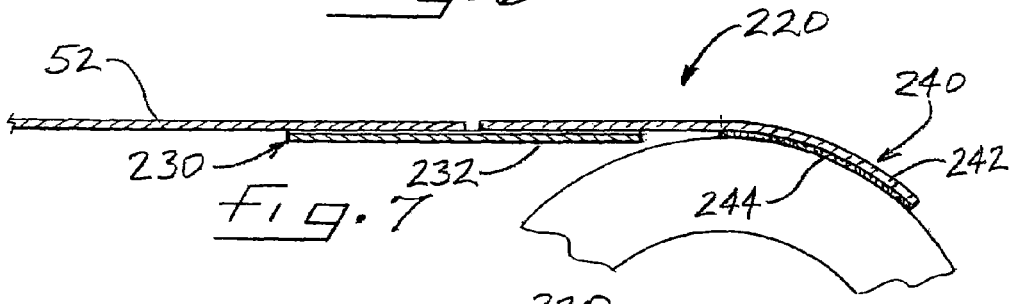
FIG. 7 shows a startup and splicing mechanism in accordance with a fifth embodiment of the invention, attaching a tail end of a web to a core.

A fifth embodiment of a mechanism 220 in accordance with the invention is shown in FIG. 7. The mechanism 220 includes a web component 230 comprising a splicing tape 232 and a core component 240 comprising a substrate 242 having adhesive 244 on a core-attaching portion of the substrate. Both the splicing tape and the substrate are flat (i.e., not folded). A leading portion of the splicing tape 232 is releasably adhered to a free end portion of the substrate 242, and a tail portion of the splicing tape is adhered to the tail end 52 of a web. The mechanism thereby attaches the tail end to the core to assist in startup of winding of the web about the core to form a roll. At completion of unwinding of the roll, as the tail end of the web pulls the splicing tape 232 away from the core, the adhesive interface between the splicing tape and the core component 240 is initially placed in shear; the resulting shear stress may be sufficient to break the adhesive bond and detach the splicing tape from the core component. Alternatively, as the core continues to rotate, the core component will begin to fold back on itself, placing the core component and splicing tape in a more-advantageous relative orientation to peel the core component off the splicing tape. Once the splicing tape completely detaches form the core component, the splicing tape assumes the configuration as shown in FIG. 3C and is positioned for splicing the tail end of the web to a leading end of another web as illustrated in FIG. 3D.

FIGS. 8A and 8B depict a mechanism 320 in accordance with a sixth embodiment of the invention. The mechanism 320 includes a web component 330 comprising a folded splicing tape 332 substantially as described in connection with FIG. 6. The core component 340 comprises a layer of release material 343 disposed on the cylindrical outer surface of the winding core. The leading folded portion of the splicing tape 332 is releasably adhered to the release material 343 on the core and the tail portion of the splicing tape is adhered to the tail end 52 of a web so as to attach the tail end to the core and thereby assist in startup of winding of the web about the core. At completion of unwinding, as the tail end of the web is advanced away from the core, the splicing tape 332 is pulled away from the core and unfolds and peels off from the release material 343 of the core component. Once the splicing tape completely detaches form the core component 340, the splicing tape assumes the configuration as shown in FIG. 8B and is positioned for splicing the tail end of the web to a leading end 54 of another web while the release material 343 is shown as covering the entire outer surface of the core, alternatively the release material could be isolated to that portion of the outer surface to which the splicing tape is to be adhered.

The mechanism 320 includes a splice-detection element 333 incorporated into the splicing tape 332. As shown, the splice-detection element 333 is disposed on the surface of the splicing tape 332 opposite the surface that attaches to the web, and is located on the tail portion of the splicing tape; alternatively, the splice-detection element could be located on the other surface of the tape, or could be embedded or impregnated in the thickness of the tape, and/or could be located on the leading portion of the tape. The splice-detection element is detectable by a suitable sensor so that the location of the splice between webs can be automatically sensed. This is useful during a converting operation, for example, because products made from the portion of the web material containing the splice must be discarded; the ability to automatically detect the splice can enable automatic discarding of such defective products. The splice-detection element can be detected in various ways, including but not limited to optical detection or metal detection (e.g., induction imbalance, pulse induction, or beat frequency oscillation). Thus, the splice-detection element may have an optically detectable property (e.g., opacity, color, reflectivity, etc.). Alternatively, the splice-detection element may incorporate metal (e.g., metal foil, iron shavings, etc.).

Any of the other embodiments shown in FIGS. 1 through 7 may also include a splice-detection element, if desired.

While a release material is shown in the embodiments of FIGS. 4, 5, and 8A, the release material may be omitted if the surface to which the splicing tape is adhered is such that the splicing tape will readily and cleanly detach from the surface. Conversely, the embodiments of FIGS. 1–3, 6, and 7, although not specifically shown as including a release material, can include a release material if desired.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A mechanism to aid in startup of winding a web onto a winding core to form a roll of the web and to aid in subsequent splicing of the web during unwinding of the roll, the mechanism comprising:

a core component comprising a core-attaching portion structured and arranged to attach to the core and having a free end portion joined to the core-attaching portion, the free end portion extending out from the core when the core-attaching portion is attached to the core, the core component comprising a substrate having an upper surface and a lower surface, a layer of release material being disposed on the upper surface of the substrate, a portion of the substrate being folded over along a fold line such that the free end portion of the core component comprises two layers of the substrate and the core-attaching portion comprises one layer of the substrate, the layer of release material forming both opposite surfaces of the free end portion; and a web component comprising an adhesive splicing tape structured and arranged to attach to a tail end of a web with a leading portion of the splicing tape extending out from the tail end of the web, the leading portion being adhered to the free end portion of the core component with sufficient adhesive bonding strength to remain attached to the free end portion when winding tension is exerted between the core and the tail end of the web during startup of winding of the web onto the core to form a roll, yet the release material on the free end portion allowing the leading portion of the splicing tape to detach from the core component at completion of unwinding of the roll such that the leading portion extending from the tail end of the web is exposed for attachment to a leading end of another web being unwound from a new roll to splice the webs together.

2. The mechanism of claim 1, wherein the core component is structured and arranged such that the folded-over portion of the substrate is free to unfold when the splicing tape is pulled in a direction away from the fold line at completion of unwinding, whereby the splicing tape and folded-over portion of the substrate are placed in relative orientations favoring peeling apart thereof.

3. The mechanism of claim 1, wherein the web component is attached to the folded-over portion of the substrate.

4. The mechanism of claim 3, wherein the fold line of the substrate is generally perpendicular to a length direction of the substrate.

5. The mechanism of claim 4, wherein web component is attached to the core component such that a length direction of the web component is generally perpendicular to the fold line of the substrate.

6. The mechanism of claim 1, wherein the core component further comprises a double-sided adhesive tape having one side adhered to the lower surface of the substrate, an opposite side of the double-sided adhesive tape being positioned to be attached to the core.

7. A mechanism to aid in startup of winding a web onto a winding core to form a roll of the web and to aid in subsequent splicing of the web during unwinding of the roll, the mechanism comprising:

a core component structured and arranged to attach to the core; and a web component having a tail portion structured and arranged to attach to a tail end of a web and having a leading portion with adhesive disposed thereon and being releasably adhered to the core component with sufficient adhesive bonding strength to remain attached to the core component when winding tension is exerted between the core and the tail end of the web during startup of winding of the web onto the core to form a roll, yet the adhesive bonding strength being sufficiently low to allow the leading portion of the web component to detach from the core component at completion of unwinding of the roll such that the adhesive on the leading portion is exposed for attachment to a leading end of another web being unwound from a new roll to splice the webs together, wherein the web component comprises a splicing tape having adhesive disposed on one side of the tape, the leading portion of the web component being folded beneath the tail portion so that the adhesive on the leading portion faces away from the tail portion, the leading portion being adhered to the core component.

8. The mechanism of claim 7, wherein the core component comprises a layer of release material disposed on the core so as to form a release surface to which the leading portion of the web component is releasably adhered.

9. The mechanism of claim 7, wherein the core component comprises a substrate having a core-attaching portion structured and arranged to attach to the core and a free end portion joined to the core-attaching portion, the free end portion extending out from the core when the core-attaching portion is attached to the core, the leading portion of the web component being releasably adhered to the free end portion.

10. A mechanism to aid in startup of winding a web onto a winding core to form a roll of the web and to aid in subsequent splicing of the web during unwinding of the roll, the mechanism comprising:

a core component structured and arranged to attach to the core; and a web component having a tail portion structured and arranged to attach to a tail end of a web and having a leading portion with adhesive disposed thereon and being releasably adhered to the core component with sufficient adhesive bonding strength to remain attached to the core component when winding tension is exerted between the core and the tail end of the web during startup of winding of the web onto the core to form a roll, yet the adhesive bonding strength being sufficiently low to allow the leading portion of the web component to detach from the core component at completion of unwinding of the roll such that the adhesive on the leading portion is exposed for attachment to a leading end of another web being unwound from a new roll to splice the webs together, wherein the web component includes a splice-detection element that is detectable by a sensor.

11. The mechanism of claim 10, wherein the splice-detection element comprises a metal for detection by a metal-detecting sensor.

12. A method for unwinding and splicing a web, comprising the steps of:

providing a roll of the web wound about a winding core, a tail end of the web being attached to the winding core with a two-component mechanism having a core component attached directly to an outer surface of the core and a web component attached to the tail end, the web component being releasably attached to a leading portion of the web component that projects out from the tail end of the web, the leading portion of the web component having an adhesive thereon, the adhesive being attached to and covered by the web component;

unwinding the web from the roll until the tail end of the web is advanced away from the core to cause the web component to detach from the core component and thereby expose the adhesive on the leading portion of the web component; and splicing the tail end of the web to a leading end of a second web by attaching the leading end to the adhesive on the leading portion of the web component;

wherein the core component is provided in the form of a substrate affixed to the core and having a free end portion that remains unattached to the core, the free end portion having a release material disposed thereon for releasable attachment to the leading portion of the web component;

and wherein the free end of the core component is provided to have a folded-over portion of the substrate, the folded-over portion defining a core-facing surface on which the release material is disposed, the folded-over portion lying between the core and another portion of the substrate that is attached to the folded-over portion along a fold line, and wherein during the unwinding step the folded-over portion is pulled by the web component as the tail end of the web is advanced away from the core such that the folded-over portion unfolds about the fold line and thereby places the folded-over portion in a more advantageous orientation relative to the web component for peeling apart the web component and folded-over portion.

13. An assembly facilitating winding of a web into a roll and splicing of the web during unwinding, comprising:

a winding core having a cylindrical outer surface;

a core component attached directly to the outer surface of the winding core; and a splicing tape having adhesive disposed on one side thereof, a portion of the splicing tape being adhered to the core component;

wherein the core component and the adhesive of the splicing tape are structured and arranged such that the splicing tape adheres to the core component in releasable fashion; wherein the core component comprises a substrate having a core-attaching portion attached to the outer surface of the core and a free end portion unaffixed to the core;

and wherein an end region of the free end portion of the substrate is folded beneath the remainder of the free end portion and the splicing tape is adhered to the end region.

14. The assembly of claim 13, wherein the core component comprises a layer of release material disposed on the outer surface of the winding core.

* * * * *